US011021290B2

(12) United States Patent
Pedercini et al.

(10) Patent No.: US 11,021,290 B2
(45) Date of Patent: Jun. 1, 2021

(54) LABELING MACHINE

(71) Applicant: SACMI VERONA S.P.A., Imola (IT)

(72) Inventors: Maurizio Pedercini, Marmirolo (IT); Daniele Mazzucco, Marmirolo (IT)

(73) Assignee: SACMI VERONA S.P.A., Imola (IT)

( * ) Notice: Subject to any disclaimer, the term of this patent is extended or adjusted under 35 U.S.C. 154(b) by 345 days.

(21) Appl. No.: 15/770,682

(22) PCT Filed: Oct. 26, 2016

(86) PCT No.: PCT/EP2016/075844
§ 371 (c)(1),
(2) Date: Apr. 24, 2018

(87) PCT Pub. No.: WO2017/072194
PCT Pub. Date: May 4, 2017

(65) Prior Publication Data

US 2019/0055046 A1 Feb. 21, 2019

(30) Foreign Application Priority Data

Oct. 30, 2015 (IT) ..... 102015000067371

(51) Int. Cl.
*B65C 9/18* (2006.01)

(52) U.S. Cl.
CPC ..... *B65C 9/1865* (2013.01); *B65C 9/1892* (2013.01)

(58) Field of Classification Search
CPC ..... B65C 9/18; B65C 9/1865; B65C 9/1892; B65C 9/08; B65C 9/42; B65C 11/004; B65C 11/021; B65C 11/046; B65C 11/064
(Continued)

(56) References Cited

U.S. PATENT DOCUMENTS

2004/0094655 A1* 5/2004 Trutschel ..... B65H 19/12 242/533.7
2009/0256023 A1* 10/2009 Murase ..... B65H 75/242 242/573.9
(Continued)

FOREIGN PATENT DOCUMENTS

CN 102390186 A 3/2012
CN 104284838 A 1/2015
(Continued)

OTHER PUBLICATIONS

International Search Report dated Jan. 11, 2017 re: Application No. PCT/EP2016/075844; pp. 1-3; citing: GB 1 432 647 A, WO 2010/018368 A2 and EP 0 980 832 A1.
(Continued)

*Primary Examiner* — Matthew J Daniels
*Assistant Examiner* — Gregory Chad Grosso
(74) *Attorney, Agent, or Firm* — Cantor Colburn LLP

(57) ABSTRACT

A labeling machine having a device for applying labels to containers to be labeled, the application device being fed by a feeding unit supported by a base frame and including at least one device for supporting a spool of a film of labels which is arranged around a hollow tubular body. The supporting device includes at least one base body supported by the base frame and an elongated body which can be associated removably with the base body by virtue of a removable connecting component, the elongated body being insertable into the hollow tubular body of the spool when separated from the base body. Locking components are further provided which are adapted to lock the elongated body in the tubular body with the elongated body separated from the base body.

9 Claims, 4 Drawing Sheets

(58) Field of Classification Search
USPC ..... 156/538, 540, 541, 542, 428
See application file for complete search history.

(56) References Cited

U.S. PATENT DOCUMENTS

| | | | | |
|---|---|---|---|---|
| 2014/0209249 | A1* | 7/2014 | Bevilacqua | B65C 9/18 156/539 |
| 2015/0136332 | A1* | 5/2015 | Cattabriga | B65C 9/0006 156/767 |

FOREIGN PATENT DOCUMENTS

| | | | |
|---|---|---|---|
| CN | 104724338 | A | 6/2015 |
| EP | 0980832 | A1 | 2/2000 |
| GB | 1432647 | A | 4/1976 |
| WO | 2010018368 | A2 | 2/2010 |

OTHER PUBLICATIONS

Written Opinoin dated Jan. 11, 2017 re: Application No. PCT/EP2016/075844; pp. 1-5; citing: GB 1 432 647 A, WO 2010/018368 A2 and EP 0 980 832 A1.

* cited by examiner

LABELING MACHINE

TECHNICAL FIELD

The present disclosure relates to a labeling machine.

BACKGROUND

Labeling machines are known for applying labels on containers.

In many cases labeling machines have a feeding unit which has at least one supporting device for respective spools of film of labels.

In particular, the labels can be provided directly by the film unwound from the spool, after a cutting operation, or it is possible for labels, for example of the self-adhesive type, to be peeled off a backing ribbon, which is also wound around a spool, and then applied to the container.

The label application device is fed by a device for unwinding the film from the spool, which is supported by a supporting device, known as a spool carrier, which is able to rotate with respect to the frame about an axis that coincides with the axis of the spool.

Generally, in use, the spool is supported by the spool carrier so that its axis is arranged substantially vertically.

Conventional spool carriers are constituted by a disk-like supporting body, which lies on a horizontal plane, from which rises an elongated body, also known as a spindle, which extends along a vertical direction and over which the spool is fitted.

Locking the spool in place on the spool carrier is ensured by having, in some cases, an upper clamping body intended to be screwed onto the top portion of the elongated body or by using an expandable spindle.

A drawback of the feeder assemblies currently on the market is linked to the difficulties operators have in performing the operations to load and remove the spools onto and from the respective spool carriers, especially if they are spools of a certain weight.

The operator in fact has to lift the spool to a height that is such as to be able to fit it, from above, onto the spindle.

SUMMARY

The aim of the present disclosure is to solve the above mentioned drawbacks, by providing a labeling machine, and in particular a feeding unit for labeling machines, that makes the operations to load and remove the spools onto and from the respective spool carriers easier and more practical.

Within this aim, the disclosure provides a labeling machine that makes it possible to assist the operations to load and remove the spools onto and from the respective spool carriers, thus reducing the effort that the operators have to make during such operations.

This aim and these and other advantages which will become better apparent hereinafter are all achieved by providing a labeling machine comprising a device for applying labels to containers to be labeled, said device being fed by a feeding unit supported by a base frame and comprising at least one device for supporting a spool of a film of labels which is arranged around a hollow tubular body, wherein said supporting device comprises at least one base body supported by said base frame and an elongated body which can be associated removably with said base body by virtue of removable connecting means, said elongated body being insertable into said hollow tubular body of said spool when separated from said base body, locking means being further provided which are adapted to lock said elongated body in said tubular body with said elongated body separated from said base body.

BRIEF DESCRIPTION OF THE DRAWINGS

Further characteristics and advantages of the disclosure will become better apparent from the description of some preferred, but not exclusive, embodiments of a labeling machine according to the disclosure, which are illustrated by way of non-limiting example in the accompanying drawings wherein.

DETAILED DESCRIPTION OF THE DRAWINGS

Figure 1:
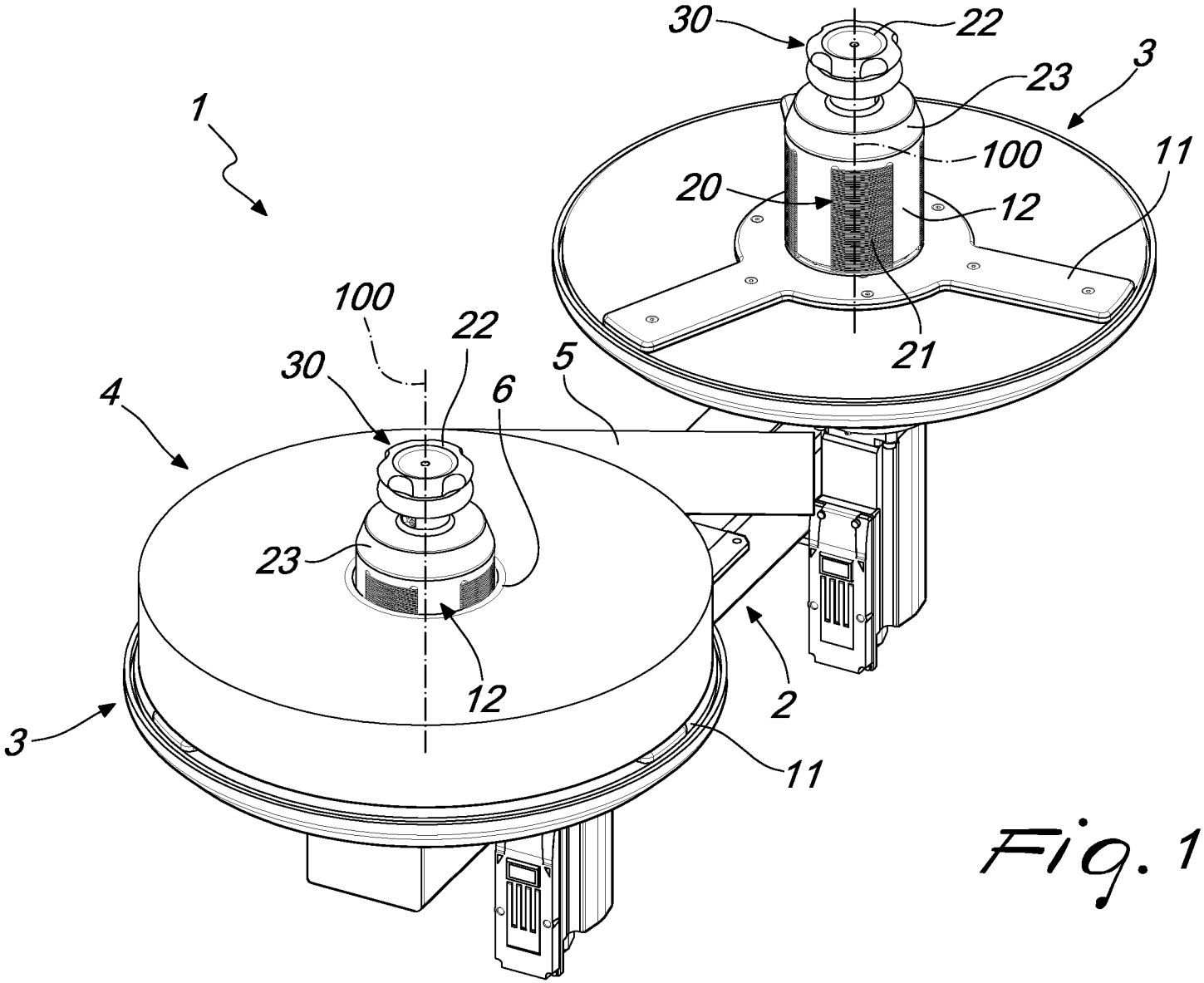
FIG. 1 is a perspective view of a feeding unit.
Figure 2:
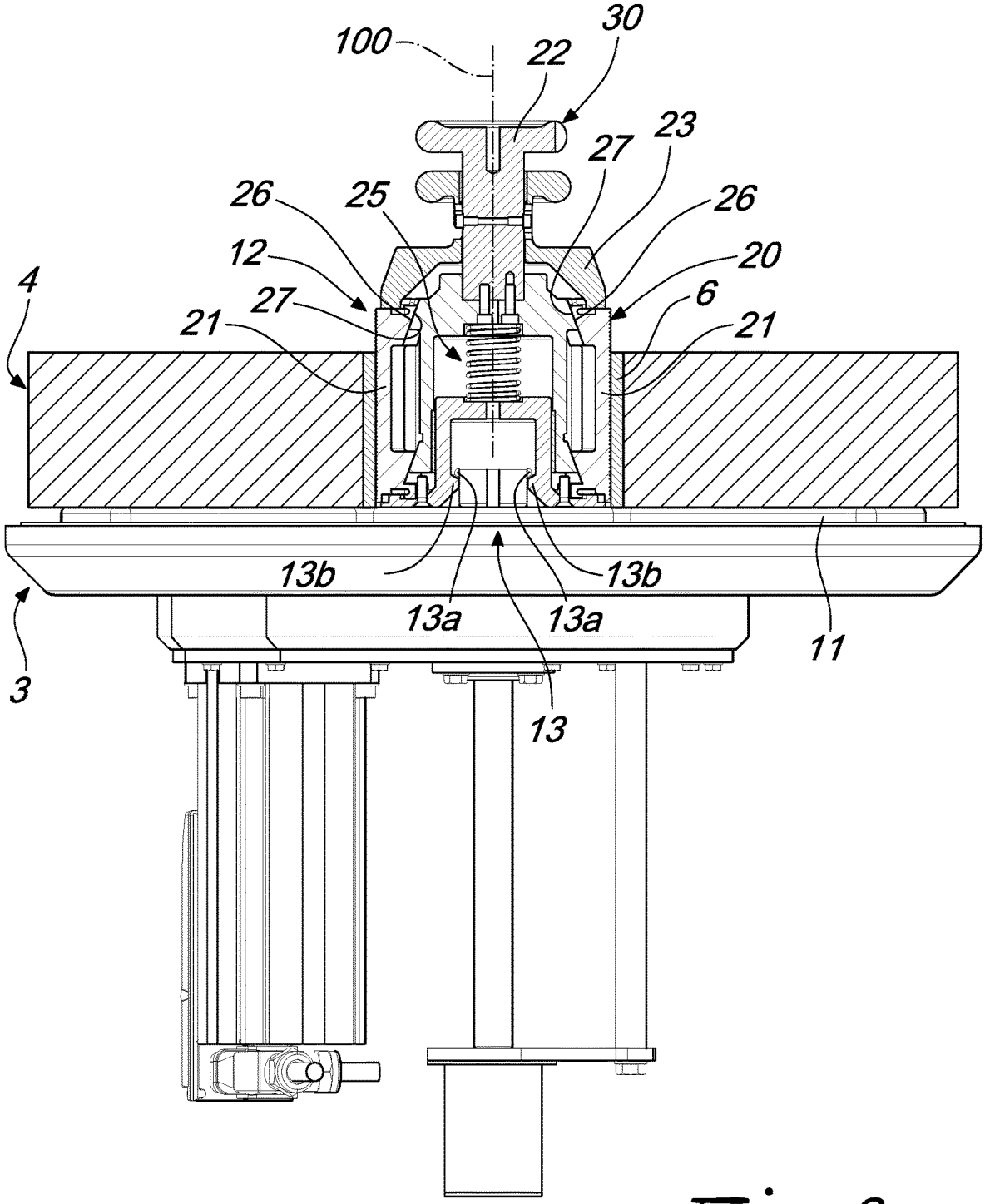
FIG. 2 is a diametrical cross-sectional view of a feeding unit according to the disclosure.

In the embodiments illustrated below, individual characteristics shown in relation to specific examples may in reality be interchanged with other, different characteristics, existing in other embodiments.

With reference to FIGS. 1-5, the present disclosure relates to a labeling machine that comprises a device for applying labels to containers to be labeled.

The application device is fed by a feeding unit 1 supported by a base frame 2 and comprises at least one device 3 for supporting a spool 4 of a film 5 of labels which is arranged about a hollow tubular body 6.

For example, the spool 4 can comprise a continuous film of plastic material or of paper to be cut in order to provide single labels or it can be of the type presenting a backing ribbon of self-adhesive labels.

According to the present disclosure, the supporting device 3 comprises at least one base body 11 supported by the base frame 2, and an elongated body 12 which can be associated detachably with the base body 11 by way of removable connecting means 13.

The elongated body 12 is insertable in the hollow tubular body 6 of the spool 4 when separated from the base body 11.

The elongated body 12 is disconnectable from the hollow tubular body 6 of the spool 4 even when separated from the base body 11.

Locking means 20 are further provided, which are adapted to lock the elongated body 12 in the tubular body 6 with the elongated body 12 separated from the base body 11.

Obviously, the locking means 20 can immobilize the elongated body 12 in the tubular body 6 when the elongated body 12 is associated with the base body 11 as well.

Preferably, the elongated body 12 comprises at least one grip portion 30.

In particular, the grip portion 30 is adapted to allow the movement of the spool 4 with respect to the feeding unit 1.

Specifically, the grip portion makes it possible to move the spool 4, which is stably locked to the elongated body 12 by virtue of the action of the locking means 20, in order to load it onto or remove it from the feeding unit 1.

Preferably, the grip portion 30 can be adapted to be coupled to movement devices.

According to a preferred embodiment, the locking means 20 comprise at least one portion 21 of the outer surface of the elongated body 12.

Such at least one portion 21 can expand in a radial direction in order to lock onto the inner surface of the respective tubular body 6.

Conveniently, the locking means 20 comprise a plurality of expandable portions 21, which are mutually angularly spaced apart from each other about the longitudinal axis 100 of the elongated body 12.

Conveniently, the base body 11 comprises a supporting element for the spool 4.

Preferably, the supporting element comprises a disk-like plate that lies, during use, on a substantially horizontal plane.

The removable connecting means 13 comprise at least one engagement body 13*a* defined on the base body 11 and an abutment body 13*b* arranged substantially at a first end of the elongated body 12.

For the purposes of example, the base body 11 can support a plurality of engagement bodies 13*a* that have respective axial locking teeth, which are adapted to engage, when the elongated body 12 is associated with the base body 11, in respective locking seats defined by the abutment body 13*b*.

Such solution makes it possible to axially immobilize the elongated body 12 with respect to the base body 11.

Obviously, the removable connecting means 13 can comprise a shape coupling between a portion of the elongated element 12 and a portion of the base element 11 which is adapted to render the elongated body 12 integral with the base body 11 in rotation about the longitudinal axis 100.

According to a preferred embodiment, the locking means 20 can be driven by at least one actuation body 22 which is connected kinematically to the elongated body 12.

Conveniently, the actuation body 22 can move with respect to a supporting body 23 for the expandable portions 21 along an actuation direction in order to produce the expansion of the portion or portions 21 in a radial direction.

Advantageously, the actuation body 22 is arranged at the end of the elongated body 12 that lies opposite the first end.

Preferably, the actuation direction extends substantially parallel to the axis 100 of the elongated body 12.

Specifically, a movement of the actuation body 22 in the direction away from the first end produces the expansion of the expandable portion or portions 21 of the outer surface of the elongated body 12.

Advantageously, between the supporting body 23 of the portion or portions 21 and the actuation body 22 there is a preloading element 25, for example a spring element, which is adapted to apply a force between the supporting body 23 and the actuation body 22 that is aimed at expanding the portion or portions 21 so as to ensure a sufficient locking force between the elongated body 12 and the inner surface of the hollow tubular body 6.

Means of retention of the actuation body 22 are provided in a closer position with respect to the first end of the elongated body 12, which are adapted to contrast the effect of the preloading element 25 so as to keep the portions 21 in a non-expanded position in order to allow the insertion into and/or the withdrawal out of the hollow tubular body 6.

In this regard, the locking means 20 can have respective inclined mating planes 26 and 27 which are integral, respectively, with the supporting body 23 of the portions 21 and with the actuation body 22.

In this manner, the action of the preloading element 25 causes the expansion of the portions 21 and therefore the locking in place of the elongated element 12 in the hollow tubular body 6.

During the movement operations, the weight of the spool 4, which hangs from the elongated element 12 and, in particular, is integral with the portions 21, tends to exert a downward force on the supporting body 23 which in turn is transferred, by virtue of the contact between the inclined mating planes 26 and 27, to a thrust in the direction of expansion of the portions 21 that is capable of further increasing the locking in place of the elongated body 12 in the tubular element 6.

The actuation body 22 defines, in particular, the grip portion 30.

Operation of the labeling machine according to the disclosure is evident from the foregoing discussion.

Figure 3:
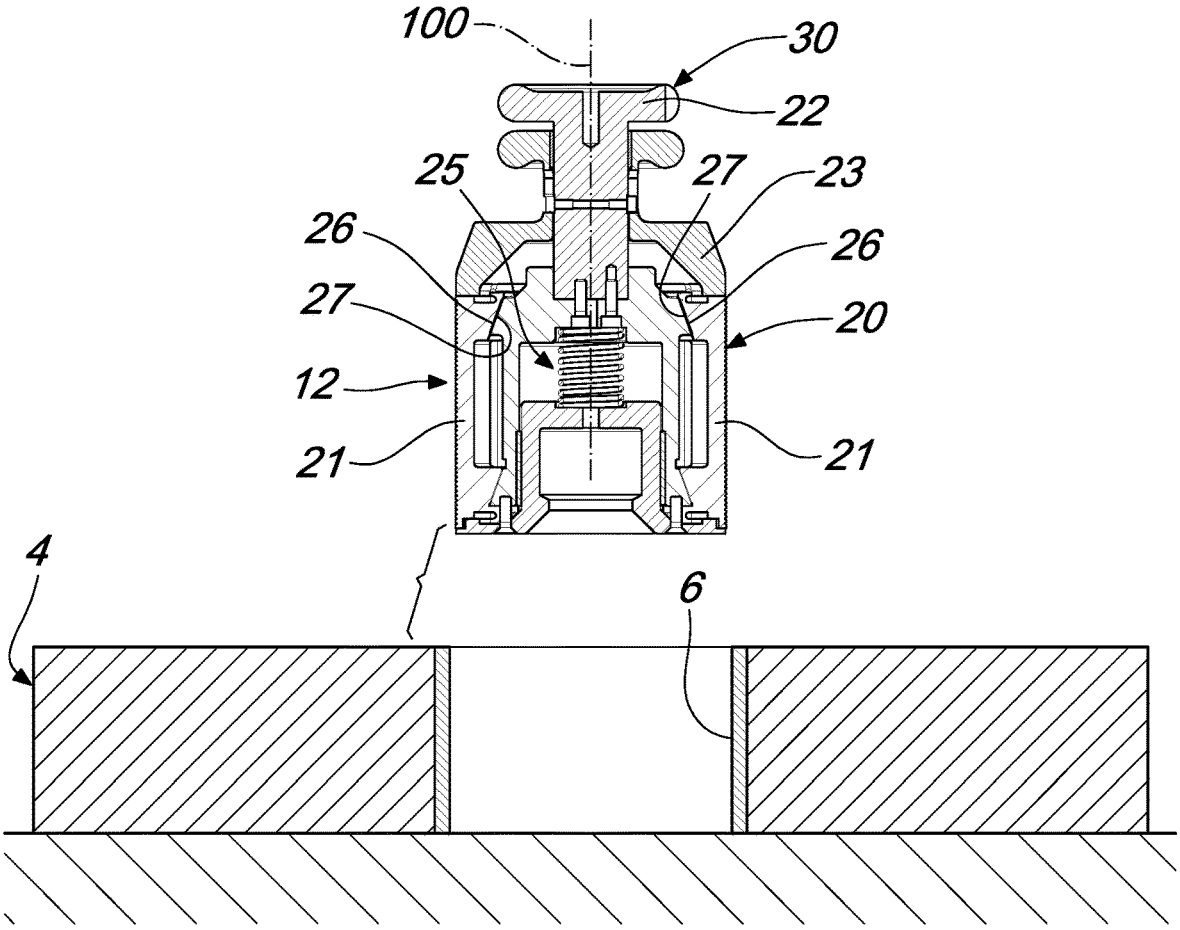
FIGS. 3-5 are cross-sectional views of a locking sequence of the elongated body to a spool of labels to be moved.
Figure 4:
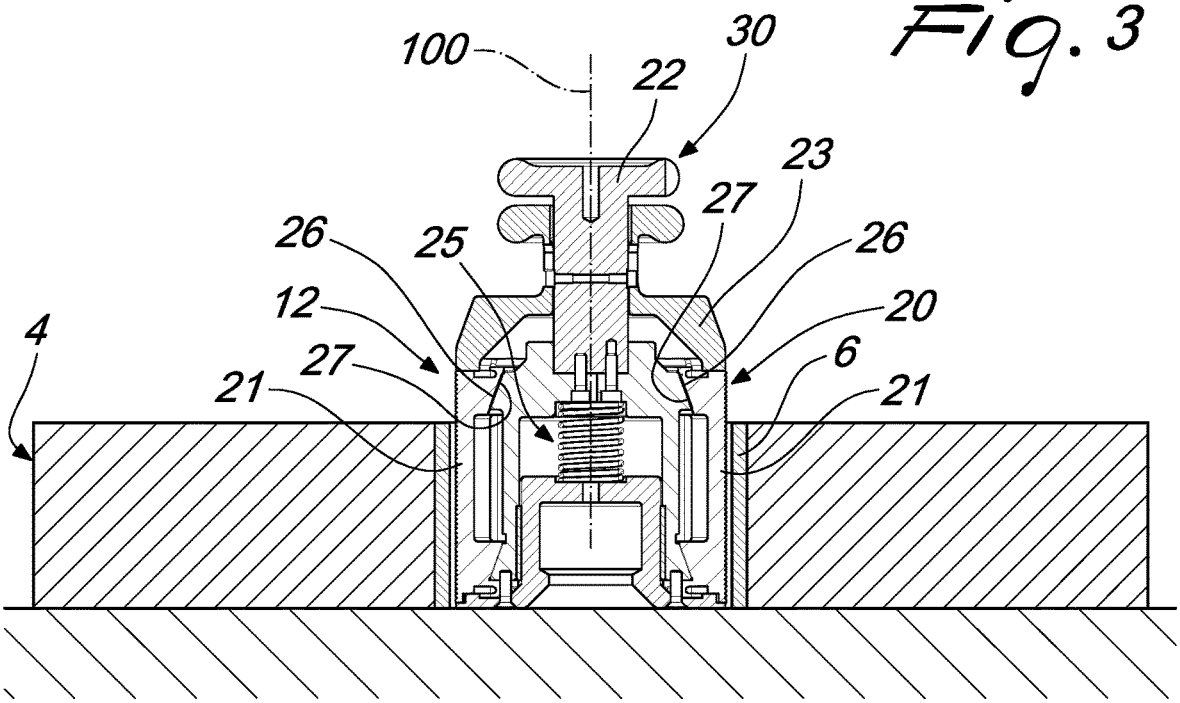
Figure 5:
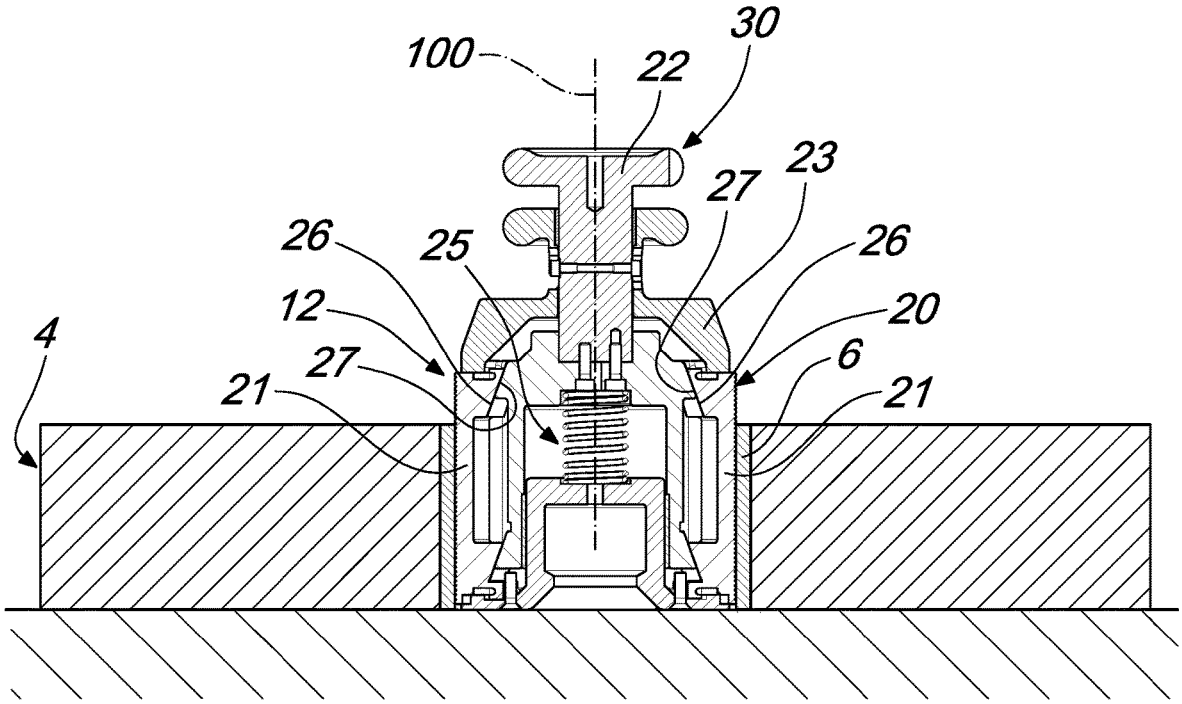

When the necessity arises to load the spool 4 on the feeding unit 1, the operator proceeds to insert the elongated element 12, which was previously separated from the respective base body 11, into the tubular element 6 (FIG. 3).

Obviously, the insertion can occur if the portions 21 are in the non-expanded or retracted condition.

The operator then proceeds to activate the locking means 20, by acting on the retention means so as to free the preloading element 25 with the consequent expansion of the portions 21.

Once the elongated body 12 is immobilized in the hollow tubular element 6, the operator proceeds to move the spool 4 by lifting, preferably with the aid of movement means, the grip portion 30 until the spool 4 is brought above the base body 11 in order to then subsequently connect it to the base body 11.

Similarly, the operator can proceed to unload the spools 4 from the feeding unit 1, for example if they are not completely unwound.

In this case, the operator intervenes on the removable connecting means 13, for example by way of a control device, in order to separate the elongated body 12, with which the spool 4 is integral, from the base body 11.

By acting on the grip portion 30, for example by way of movement means, the operator moves the elongated body 12 and the spool 4 which is integral therewith to the desired position.

In order to disengage the elongated body 12 from the hollow tubular body 6, the operator intervenes on the actuation body 22, contrasting the action of the preloading element 25 until the portions 21 are brought to the non-expanded or retracted condition.

By activating the retention means, the portions 21 are kept in the retracted condition and it is therefore possible as a consequence to disengage the elongated body 12 from the hollow tubular body 6.

All the characteristics of the disclosure, indicated above as advantageous, convenient or similar, may also be missing or be substituted by equivalent characteristics.

The individual characteristics set out in reference to general teachings or to specific embodiments may all be present in other embodiments or may substitute characteristics in such embodiments.

In practice it has been found that in all the embodiments the disclosure is capable of fully achieving the set aim and advantages.

The disclosure, thus conceived, is susceptible of numerous modifications and variations.

For the purposes of example, the supporting device described above can likewise be used, in addition to on feeder assemblies, on assemblies for recovering the film that is usually used as the backing for self-adhesive labels.

In practice the materials employed, provided they are compatible with the specific use, and the dimensions and shapes, may be any according to requirements.

Moreover, all the details may be substituted by other, technically equivalent elements.

The disclosures in Italian Patent Application No. 102015000067371 (UB2015A005345) from which this application claims priority are incorporated herein by reference.

The invention claimed is:

1. A labeling machine comprising: a device for applying labels to containers to be labeled, said application device being fed by a feeding unit supported by a base frame and comprising at least one device for supporting a spool of a film of labels which is arranged around a hollow tubular body, wherein said supporting device comprises at least one base body supported by said base frame and an elongated body which can be associated removably with said base body by virtue of removable connecting means, said elongated body being insertable into said hollow tubular body of said spool when separated from said base body, locking means being further provided which are adapted to lock said elongated body in said tubular body with said elongated body separated from said base body, wherein said elongated body comprises a grip portion adapted to allow the movement of said spool for the movement of said spool with respect to said feeding unit, wherein said locking means comprise at least one expandable portion of the outer surface of said elongated body that can expand in a radial direction in order to lock onto the inner surface of the respective tubular body, wherein said locking means comprise an actuation body connected kinematically to a supporting body of said at least one expandable portion, said actuation body being movable with respect to said supporting body along an actuation direction in order to cause an expansion of said at least one portion of the outer surface of said elongated body, wherein said actuation direction extends substantially parallel to an axis of said elongated body, a movement of said actuation body in the direction away from a first end of said elongated body causing the expansion of said at least one portion of the outer surface of said elongated body.

2. The labeling machine according to claim 1, wherein said actuation body defines said grip portion.

3. The labeling machine according to claim 1, wherein said base body comprises a supporting element for said spool.

4. The labeling machine according to claim 3, wherein said supporting element comprises a plate that lies, during use, on a substantially horizontal plane.

5. The labeling machine according to claim 1, wherein said removable connecting means comprise at least one engagement body defined on said base body and at least one abutment body defined substantially at a first end of said elongated body.

6. The labeling machine according to claim 1, wherein said actuation body is arranged at the end of said elongated body that lies opposite a first end of said elongated body.

7. The labeling machine according to claim 1, wherein said grip portion is adapted for coupling to movement devices.

8. The labeling machine according to claim 1, further comprising, between said supporting body and said actuation body, a preloading element adapted to apply a force, between said supporting body and said actuation body, that is aimed at expanding the at least one expandable portion in a radial direction.

9. The labeling machine according to claim 8, further comprising means for retaining said actuation body in a closer position with respect to a first end of said elongated body, said retention means being adapted to contrast the effect of said preloading element so as to keep said portions in a non-expanded or retracted position.

* * * * *